US011959217B1

(12) United States Patent
Widener

(10) Patent No.: US 11,959,217 B1
(45) Date of Patent: Apr. 16, 2024

(54) PORTABLE CLOTHES-WASHING MACHINE

(71) Applicant: Aliya Widener, Jacksonville, FL (US)

(72) Inventor: Aliya Widener, Jacksonville, FL (US)

( * ) Notice: Subject to any disclaimer, the term of this patent is extended or adjusted under 35 U.S.C. 154(b) by 225 days.

(21) Appl. No.: 17/493,965

(22) Filed: Oct. 5, 2021

(51) Int. Cl.

| | |
|---|---|
| ***D06F 13/02*** | (2006.01) |
| ***D06F 23/04*** | (2006.01) |
| ***D06F 33/34*** | (2020.01) |
| ***D06F 33/36*** | (2020.01) |
| ***D06F 33/42*** | (2020.01) |
| ***D06F 34/05*** | (2020.01) |
| ***D06F 34/10*** | (2020.01) |
| ***D06F 37/12*** | (2006.01) |
| ***D06F 39/00*** | (2020.01) |
| ***D06F 39/08*** | (2006.01) |
| ***D06F 39/12*** | (2006.01) |
| *D06F 105/02* | (2020.01) |
| *D06F 105/08* | (2020.01) |

(52) U.S. Cl.
CPC ..... *D06F 39/001* (2013.01); *D06F 23/04* (2013.01); *D06F 33/34* (2020.02); *D06F 33/36* (2020.02); *D06F 33/42* (2020.02); *D06F 34/05* (2020.02); *D06F 34/10* (2020.02); *D06F 37/12* (2013.01); *D06F 39/085* (2013.01); *D06F 39/088* (2013.01); *D06F 39/12* (2013.01); *D06F 2105/02* (2020.02); *D06F 2105/08* (2020.02)

(58) Field of Classification Search
CPC ..... D06F 13/00; D06F 13/02; D06F 13/06; D06F 13/08; D06F 17/00; D06F 17/02; D06F 17/06; D06F 17/10; D06F 39/12; D06F 39/125
See application file for complete search history.

(56) References Cited

U.S. PATENT DOCUMENTS 1,633,140 A * 6/1927 Stocking ..... D06F 13/02 68/133
2,272,517 A * 2/1942 Frantz ..... D06F 1/00 220/DIG. 28
2,430,769 A 11/1947 Hutchinson
2,588,774 A * 3/1952 Smith ..... D06F 39/006 68/148

(Continued)

FOREIGN PATENT DOCUMENTS

CN 105937149 A * 9/2016
CN 109023827 A * 12/2018
KR 20130079923 A * 7/2013

OTHER PUBLICATIONS

Machine Translation of Fu et al., CN-105937149-A, Sep. 2016. (Year: 2016).*

(Continued)

*Primary Examiner* — David G Cormier

(57) ABSTRACT

The portable clothes-washing machine is an electromechanical device. The portable clothes-washing machine is configured for use with one or more garments. The portable clothes-washing machine cleans the one or more garments. The portable clothes-washing machine comprises a housing structure, a fluid network, and a control circuit. The housing structure contains the fluid network and the control circuit. The control circuit controls the operation of the portable clothes-washing machine. The fluid network handles the flow of clean water and gray water through the portable clothes-washing machine.

14 Claims, 6 Drawing Sheets

(56) References Cited

U.S. PATENT DOCUMENTS

| | | | | |
|---|---|---|---|---|
| 2,746,279 | A | 5/1956 | Rodriquez | |
| 3,884,493 | A * | 5/1975 | Weir | B62B 3/00 16/35 R |
| 4,522,045 | A | 6/1985 | Harada | |
| 5,522,410 | A | 6/1996 | Meilleur | |
| 5,570,598 | A | 11/1996 | Haven | |
| D459,037 | S | 6/2002 | Schober | |
| 2004/0134241 | A1 | 7/2004 | Lafleur | |
| 2005/0057214 | A1 * | 3/2005 | Matan | H02J 7/0068 320/101 |
| 2013/0042652 | A1 * | 2/2013 | Brueckner | D06F 33/37 68/12.02 |
| 2018/0313022 | A1 * | 11/2018 | Piekarski | D06F 37/145 |

OTHER PUBLICATIONS

Machine Translation of Jin et al., CN-109023827-A, Dec. 2018. (Year: 2018).*
Machine Translation of Moon et al., KR20130079923A, Jul. 2013. (Year: 2013).*

* cited by examiner

PORTABLE CLOTHES-WASHING MACHINE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of washing machines having stationary receptacles wherein the washing action is effected solely by circulation or agitation of the washing liquid. (D06F17/00)

SUMMARY OF INVENTION

The portable clothes-washing machine is an electromechanical device. The portable clothes-washing machine is configured for use with one or more garments. The portable clothes-washing machine cleans the one or more garments. The portable clothes-washing machine comprises a housing structure, a fluid network, and a control circuit. The housing structure contains the fluid network and the control circuit. The control circuit controls the operation of the portable clothes-washing machine. The fluid network handles the flow of clean water and gray water through the portable clothes-washing machine.

These together with additional objects, features and advantages of the portable clothes-washing machine will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable clothes-washing machine in detail, it is to be understood that the portable clothes-washing machine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable clothes-washing machine.

It is therefore important that the claims be regarded as including such equivalent construction insofar as they do not depart from the spirit and scope of the portable clothes-washing machine. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
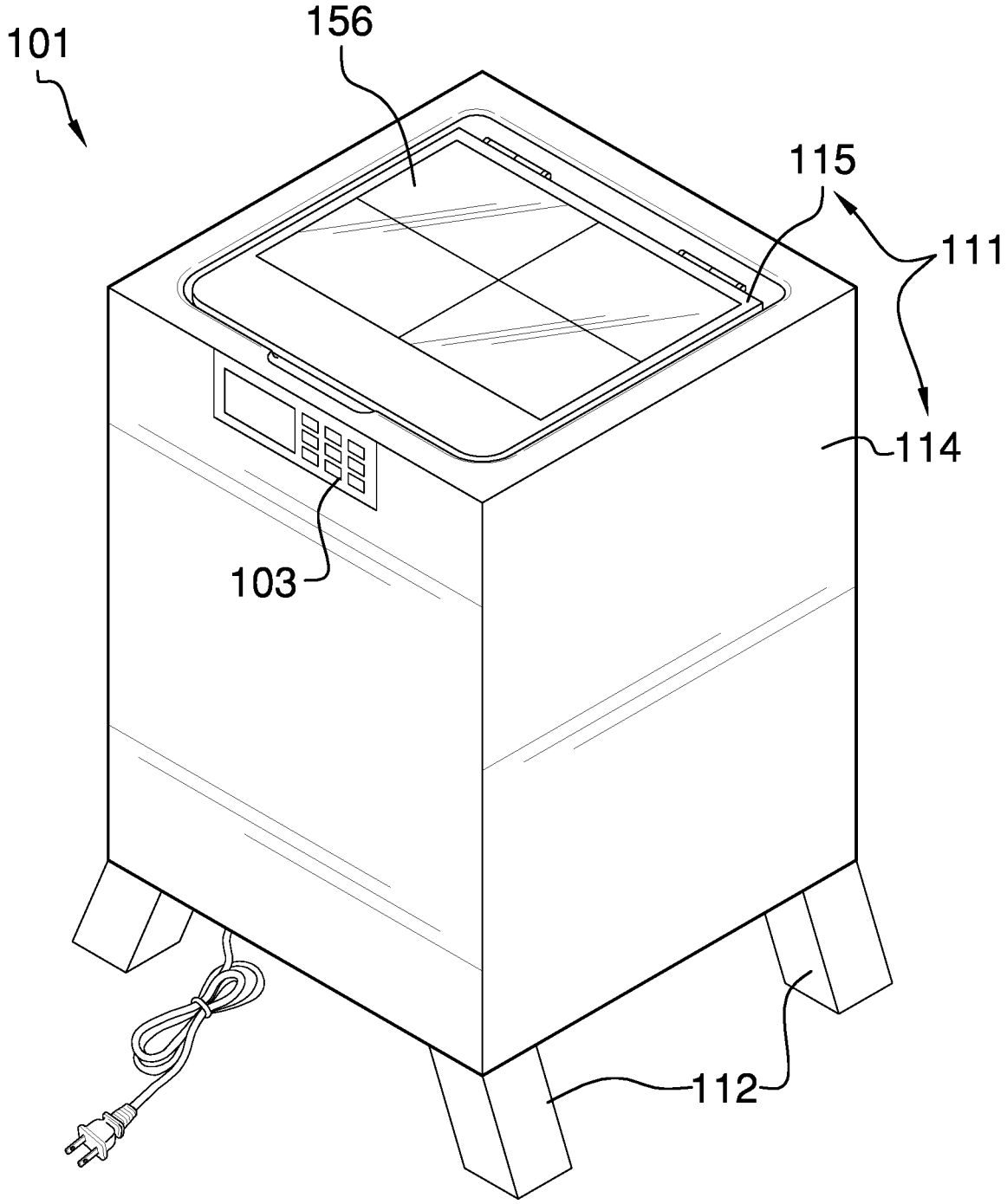
FIG. 1 is a perspective view of an embodiment of the disclosure.
Figure 2:
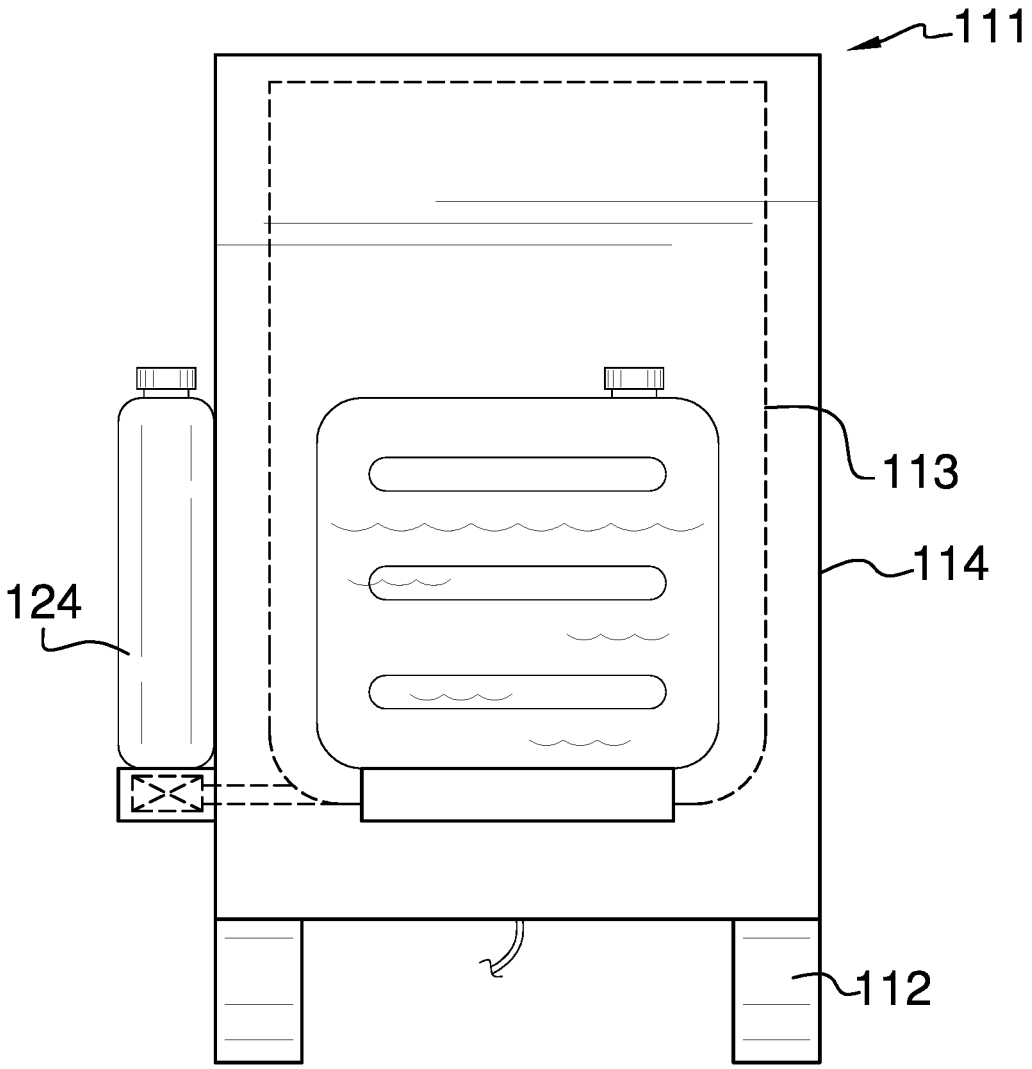
FIG. 2 is a side view of an embodiment of the disclosure.
Figure 3:
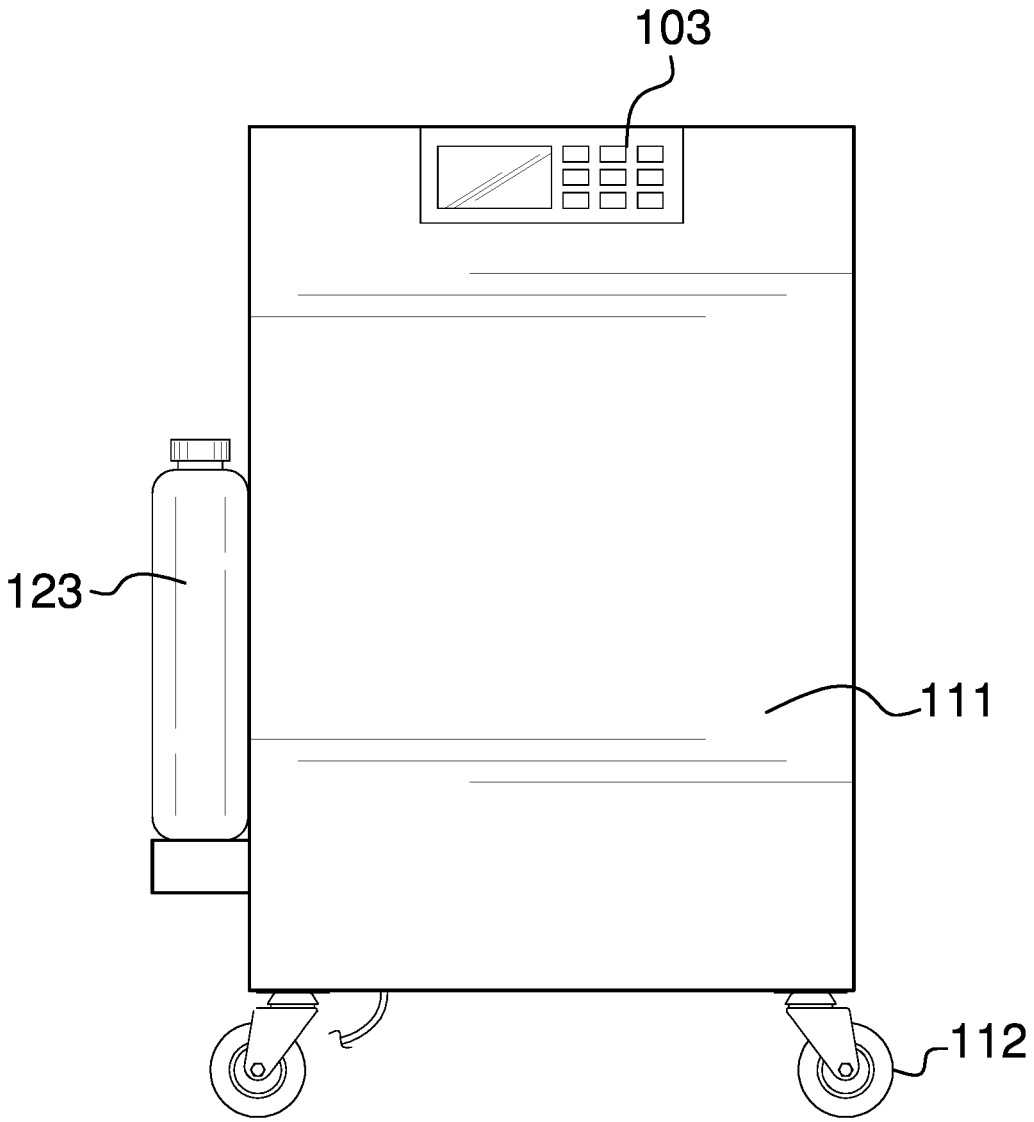
FIG. 3 is a front view of an embodiment of the disclosure.
Figure 4:
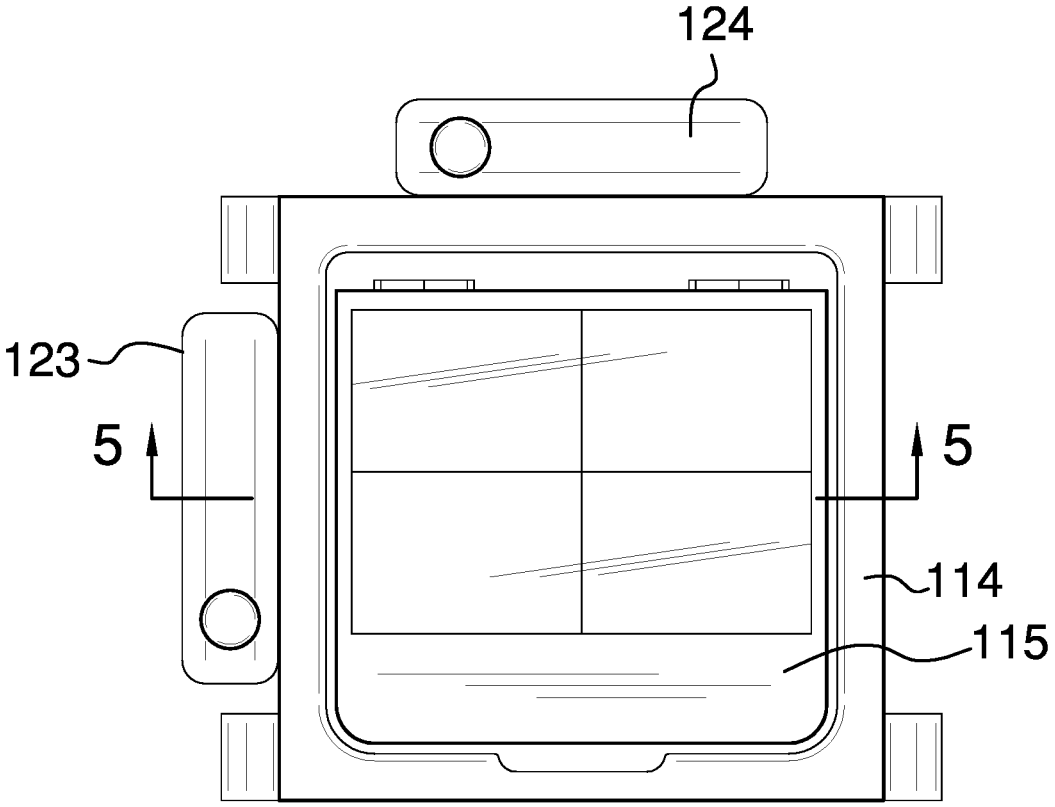
FIG. 4 is a top view of an embodiment of the disclosure.
Figure 5:
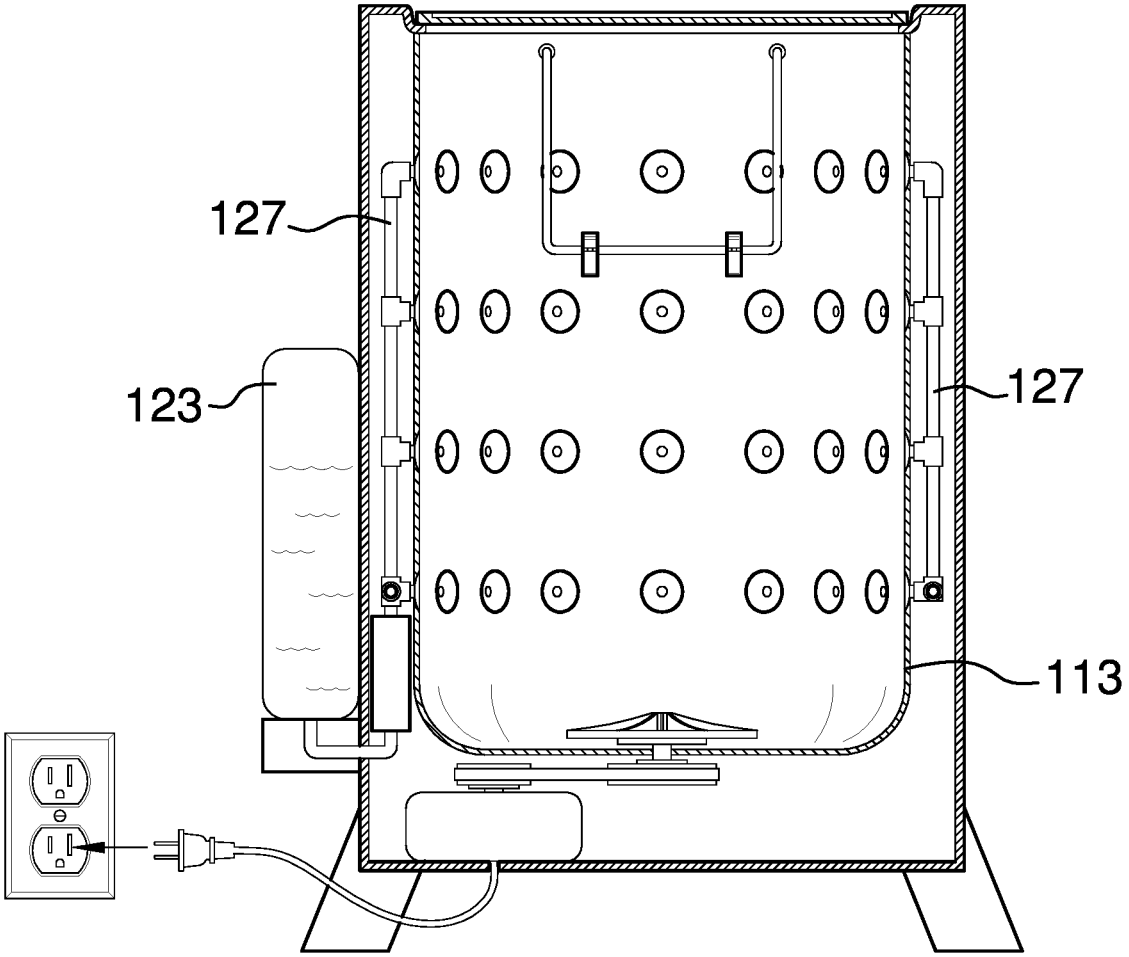
FIG. 5 is a cross-sectional view of an embodiment of the disclosure across 5-5 as shown in FIG. 4.
Figure 6:
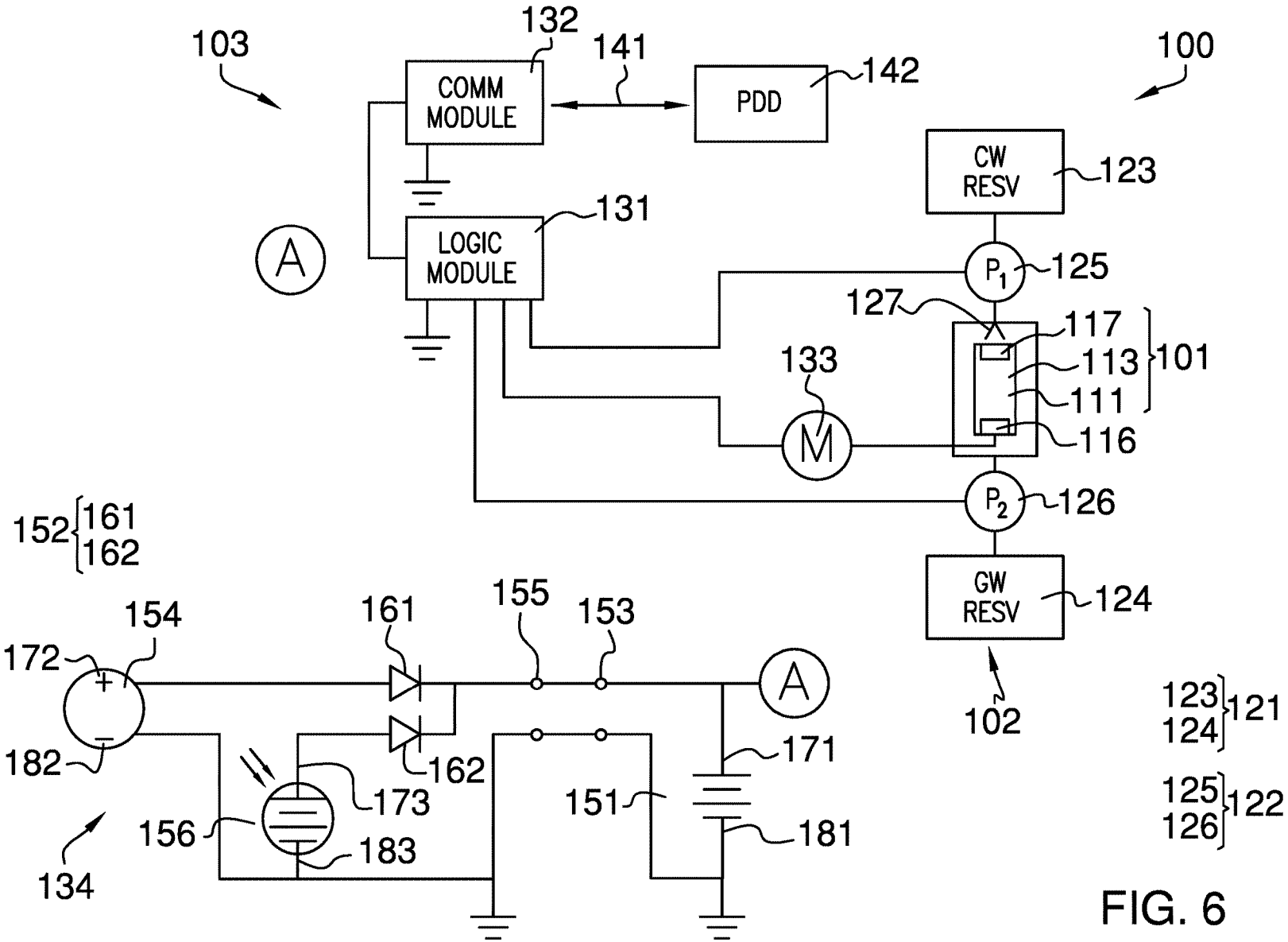
FIG. 6 is a schematic view of an embodiment of the disclosure.

Detailed reference will now be made to one or more potential embodiments of the disclosure, which are illustrated in FIGS. 1 through 6.

The portable clothes-washing machine 100 (hereinafter invention) is an electromechanical device. The invention 100 is configured for use with one or more garments. The invention 100 cleans the one or more garments. The invention 100 incorporates a housing structure 101, a fluid network 102, and a control circuit 103. The housing structure 101 contains the fluid network 102 and the control circuit 103. The control circuit 103 controls the operation of the invention 100. The fluid network 102 handles the flow of clean water and gray water through the invention 100.

The housing structure 101 is a rigid structure. The housing structure 101 contains the fluid network 102 and the control circuit 103. The housing structure 101 is formed with all apertures and form factors necessary to allow the housing structure 101 to accommodate the use and operation of the fluid network 102 and the control circuit 103. Methods to form a housing structure 101 suitable for the purposes described in this disclosure are well-known and documented in the mechanical arts. The housing structure 101 comprises a shell structure 111, a pedestal structure 112, and a basket structure 113.

The shell structure 111 is a prism shaped structure. The shell structure 111 forms the containment structure of the housing structure 101. The shell structure 111 is a rigid structure. The shell structure 111 contains the fluid network 102, the control circuit 103, and the basket structure 113. The shell structure 111 is formed with all apertures and form factors necessary to allow the shell structure 111 to accommodate the use and operation of the fluid network 102, the control circuit 103, and the basket structure 113. Methods to form a shell structure 111 suitable for the purposes described in this disclosure are well-known and documented in the mechanical arts. The shell structure 111 comprises a pan structure 114 and a lid 115.

The pan structure 114 is a mechanical structure. The pan structure 114 forms the containment structure of the shell structure 111. The pan structure 114 is a prism shaped structure. The pan structure 114 is formed as a pan. The lid 115 is a disk shaped structure. The lid 115 attaches to the open face of the pan structure 114 such that the lid 115 rotates relative to the pan structure 114. The lid 115 rotates between a closed position and an open position. The lid 115 controls access into the hollow interiors of the pan structure 114 and the basket structure 113.

The pedestal structure 112 is a load bearing structure. The pedestal structure 112 attaches to the inferior surface of the shell structure 111. The pedestal structure 112 elevates the shell structure 111 above a supporting surface. In the first potential embodiment of the disclosure, the pedestal structure 112 is a rolling structure such that the invention 100 is portable.

The basket structure 113 transfers the load carried by the shell structure 111 to the supporting surface. The basket structure 113 is a prism shaped structure. The basket structure 113 is formed as a pan. The basket structure 113 forms a foraminous structure that allows water to flow into and out of the containment space formed by the basket structure 113. The basket structure 113 inserts in the interior space of the shell structure 111. The basket structure 113 inserts into the shell structure 111 such that the open face of the basket structure 113 is proximal to the open face of the shell structure 111. The basket structure 113 contains the one or more garments during the cleaning process. The basket structure 113 comprises an agitator 116 and a suspension bar 117.

The agitator 116 is a mechanical structure. The agitator 116 is a rotating structure. The agitator 116 mounts in the basket structure 113 of the housing structure 101. The control circuit 103 provides the motive forces necessary to rotate the agitator 116. The control circuit 103 controls the rotation of the agitator 116. The rotation of the agitator 116 within the basket structure 113 causes the one or more garments contained within the basket structure 113 to move relative to each other. The movement of the one or more garments within the basket structure 113 ensures that the one or more garments are fully cleaned by the invention 100.

The suspension bar 117 is a structure that mounts within the agitator 116. The suspension bar 117 is a load bearing structure. The suspension bar 117 is configured to allow the one or more garments to be suspended from the suspension bar 117 during the cleaning process. The suspension bar 117 transfers the load of the one or more garments suspended from the suspension bar 117 to the basket structure 113.

The fluid network 102 is a mechanical structure. The fluid network 102 controls the flow of clean water and gray water through the housing structure 101. The fluid network 102 controls the flow of clean water into the pan structure 114 of the shell structure 111 of the housing structure 101. The fluid network 102 controls the flow of gray water out of the pan structure 114. The fluid network 102 comprises a plurality of reservoirs 121 and a plurality of pumps 122.

Each of the plurality of reservoirs 121 is a fluid containment structure. Each of the plurality of reservoirs 121 contains a fluid selected from the group consisting of clean water and gray water. The control circuit 103 provides the motive forces necessary to the transfer of liquids into and out of each of the plurality of reservoirs 121. The plurality of reservoirs 121 controls the transfer of liquids into and out of each of the plurality of reservoirs 121. The use of the plurality of reservoirs 121 allows for the use of the invention 100 when access to a residential plumbing system is not available. The plurality of reservoirs 121 comprises a clean water reservoir 123 and a gray water reservoir 124.

The clean water reservoir 123 is a reservoir. The clean water reservoir 123 mounts on the exterior surface of the shell structure 111. The clean water reservoir 123 contains clean water used to clean the one or more garments. The gray water reservoir 124 is a reservoir. The gray water reservoir 124 mounts on the exterior surface of the. The gray water reservoir 124 contains the water used to clean the one or more garments. The gray water reservoir 124 contains gray water that is generated after the one or more garments are cleaned by the invention 100.

Each of the plurality of pumps 122 is a mechanical structure. Each of the plurality of pumps 122 provides the motive forces necessary to move a liquid into and out of a reservoir selected from the plurality of reservoirs 121. Each of the plurality of pumps 122 generates a pressure differential used to transport a liquid into and out of a reservoir selected from the plurality of reservoirs 121. Each of the plurality of pumps 122 is electrically powered. The control circuit 103 provides the electric energy necessary to power each pump selected from the plurality of pumps 122. The control circuit 103 independently controls the operation of each pump selected from the plurality of pumps 122. The plurality of pumps 122 comprises a clean water pump 125 and a gray water pump 126.

The clean water pump 125 is an electrically operated pump. The control circuit 103 provides electric energy to necessary to operate the clean water pump 125. The control circuit 103 controls the operation of the clean water pump 125. The clean water pump 125 pumps clean water from the clean water reservoir 123 into the containment space formed by the shell structure 111. The clean water pump 125 discharges the clean water into the basket structure 113 through a plurality of spray nozzles 127. The gray water pump 126 is an electrically operated pump. The control circuit 103 provides electric energy to necessary to operate the gray water pump 126. The control circuit 103 controls the operation of the gray water pump 126. The gray water pump 126 pumps gray water from the containment space formed by the shell structure 111 into the gray water reservoir 124.

The control circuit 103 is an electric circuit. The control circuit 103 controls the operation of the invention 100. The control circuit 103 provides the motive forces that pump the clean water into the pan structure 114 of the shell structure 111 of the housing structure 101. The control circuit 103 controls the operation of the clean water pump 125. The control circuit 103 controls the operation of the gray water pump 126. The control circuit 103 provides the motive forces necessary to rotate the agitator 116. The control circuit 103 controls the operation of the agitator 116. The control circuit 103 is an independently powered electric circuit. By independently powered is meant that the control circuit 103 can operate without an electrical connection to an external power source 154.

The control circuit 103 comprises a logic module 131, a communication module 132, an agitator 116 motor 133, and a power circuit 134. The logic module 131, the communication module 132, the agitator 116 motor 133, and the power circuit 134 are electrically interconnected. The communication module 132 further comprises a wireless communication link 141 and a personal data device 142. The wireless communication link 141 forms a communication link between the personal data device 142 and the communication module 132.

The logic module 131 is a programmable electric circuit. The logic module 131 controls the operation of the clean water pump 125. The logic module 131 controls the operation of the gray water pump 126. The logic module 131 controls the operation of the agitator 116 motor 133.

The communication module 132 is a wireless electronic communication device that allows the logic module 131 to wirelessly communicate with a personal data device 142. Specifically, the communication module 132 establishes a wireless communication link 141 between the control circuit 103 and the personal data device 142 or. In the first potential embodiment of the disclosure the communication module 132 supports a communication protocol selected from the group consisting of a WiFi™ protocol or a Bluetooth™ protocol.

The personal data device 142 is a programmable electrical device. The personal data device 142 further comprises an application. The personal data device 142 provides data management and communication services through one or more functions referred to as an application. The application is a set of logical operating instructions that are performed by the personal data device 142. The addition of an application will provide increased functionality for the personal data device 142. This disclosure assumes that an application exists for the purpose of interacting with the invention 100. The personal data device 142 transmits operating instructions over the wireless communication link 141 to the control circuit 103. The communication module 132 receives the transmitted operating instructions and relays the received operating instructions to the logic module 131.

The agitator 116 motor 133 is an electric motor. The agitator 116 motor 133 mechanically attaches to the agitator 116 of the basket structure 113 of the housing structure 101. The agitator 116 motor 133 electrically connects to the logic module 131. The logic module 131 provides the electric energy necessary to power the operation of the agitator 116 motor 133. The logic module 131 controls the operation of the agitator 116. The agitator 116 motor 133 rotates the agitator 116 such that the one or more garments contained in the basket structure 113 are moved relative to each other.

The power circuit 134 is an electrical circuit. The power circuit 134 powers the operation of the control circuit 103. The power circuit 134 is an electrochemical device. The power circuit 134 converts chemical potential energy into the electrical energy required to power the control circuit 103. The power circuit 134 comprises a battery 151, a plurality of diodes 152, a charging port 153, an external power source 154, and a photovoltaic cell 156. The external power source 154 further comprises a charging plug 155, a second positive terminal 172, and a second negative terminal 182. The battery 151, the plurality of diodes 152, the charging port 153, the external power source 154, the charging plug 155, and the photovoltaic cell 156 are electrically interconnected. The plurality of diodes 152 further comprises a first diode 161 and a second diode 162. The battery 151 further comprises a first positive terminal 171 and a first negative terminal 181. The photovoltaic cell 156 further comprises a third positive terminal 173 and a third negative terminal 183. Each of the plurality of diodes 152 is a diode. Each of the plurality of diodes 152 controls the direction of the flow of electric current through the power circuit 134.

The battery 151 is an electrochemical device. The battery 151 converts chemical potential energy into the electrical energy used to power the control circuit 103. The battery 151 is a commercially available rechargeable battery 151. The chemical energy stored within the rechargeable battery 151 is renewed and restored through use of the charging port 153. The charging port 153 is an electrical circuit that reverses the polarity of the rechargeable battery 151 and provides the energy necessary to reverse the chemical processes that the rechargeable battery 151 initially used to generate the electrical energy. This reversal of the chemical process creates a chemical potential energy that will later be used by the rechargeable battery 151 to generate electricity.

The charging port 153 forms an electrical connection to an external power source 154 using a charging plug 155. The charging plug 155 forms a detachable electrical connection with the charging port 153. The charging port 153 receives electrical energy from the external power source 154 through the charging plug 155. The first diode 161 is an electrical device that allows current to flow in only one direction. The first diode 161 installs between the rechargeable battery 151 and the charging port 153 such that electricity will not flow from the first positive terminal 171 of the rechargeable battery 151 into the second positive terminal 172 of the external power source 154.

The photovoltaic cell 156 is an electrical device that converts light into electrical energy. The chemical energy stored within the rechargeable battery 151 is further renewed and restored through use of the photovoltaic cell 156. The photovoltaic cell 156 is directly wired to the battery 151. The photovoltaic cell 156 is an electrical circuit that reverses the polarity of the rechargeable battery 151 and provides the energy necessary to reverse the chemical processes that the rechargeable battery 151 initially used to generate the electrical energy. This reversal of the chemical process creates a chemical potential energy that will later be used by the rechargeable battery 151 to generate electricity.

The second diode 162 is an electrical device that allows current to flow in only one direction. The second diode 162 installs between the rechargeable battery 151 and the charging port 153 such that electricity will not flow from the first positive terminal 171 of the rechargeable battery 151 into the third positive terminal 173 of photovoltaic cell 156. The second diode 162 simultaneously installs between the photovoltaic cell 156 and the charging port 153 such that electricity will not flow from the second positive terminal 172 of the external power source 154 into the third positive terminal 173 of the photovoltaic cell 156. The photovoltaic cell 156 is defined elsewhere in this disclosure. The first diode 161 further installs between the second positive terminal 172 of the external power source 154 and the third positive terminal 173 of photovoltaic cell 156 such that electric current will not flow from the third positive terminal 173 into the second positive terminal 172.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Application or App: As used in this disclosure, an application or app is a self-contained piece of software that is especially designed or downloaded for use with a personal data device.

Battery: As used in this disclosure, a battery is a chemical device consisting of one or more cells, in which chemical energy is converted into electricity and used as a source of power. Batteries are commonly defined with a positive terminal and a negative terminal.

Bluetooth™: As used in this disclosure, Bluetooth™ is a standardized communication protocol that is used to wirelessly interconnect electronic devices.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Clean: As used in this disclosure, the term clean refers to an object without dirt, unwanted markings, or undesirable pathogens. When referring to a surface, the term clean can also refer to removing unwanted objects from the surface. The term cleaning refers to the action of making an object clean.

Cleaning Agent: As used in this disclosure, a cleaning agent is a chemical compound used to remove pathogens, dirt and detritus from a surface.

Cleaning Solution: As used in this disclosure, a cleaning solution is a chemical solution that contains a solvent used to dissolve a cleaning agent.

Closed Position: As used in this disclosure, a closed position refers to a movable barrier structure that is in an orientation that prevents passage through a port or an aperture. The closed position is often referred to as an object being "closed."

Communication Link: As used in this disclosure, a communication link refers to the structured exchange of data between two objects.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Fluid Network: As used in this disclosure, a fluid network refers to a transport structure that: a) receives a fluid into the fluid network; b) transports the fluid through a series of pipes, valves, and manifolds; and, c) discharges the fluid from the fluid network.

Foraminous: As used in this disclosure, foraminous is an adjective that describes a surface, plate, or platform that is perforated with a plurality of apertures.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Garment: As used in this disclosure, a garment is a textile based structure that is used to cover an individual. Clothes, clothing, and apparel are synonyms for garment.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gray Water: As used in this disclosure, gray water to domestically generated waste water that is no longer suitable for consumption. This definition is intended to include what is often referred to as black water.

Hang: As used in this disclosure, to hang an object is to suspend an object above a surface from above such that the inferior end of the object does not form a significant portion of the load path of the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Independent: As used in this disclosure, the term independent refers to the relationship between the operation and control of a first device and a second device. The first device and the second device are independent from each other if: a) the operation of the first device is neither impacted nor influenced by the operation of the second device; and, b) the operation of the second device is neither impacted nor influenced by the operation of the first device.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Nozzle: As used in this disclosure, a nozzle is a device that receives fluid under pressure and releases the fluid in a controlled manner into an environment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

PDD: As used in this disclosure, PDD is an acronym for personal data device.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld logical device that is used for managing personal information and communication. Examples of personal data device include, but are not limited to, cellular phones, tablets, and smartphones.

Phase: As used in this disclosure, phase refers to the state of the form of matter. The common states of matter are solid, liquid, gas, and plasma.

Photoelectric: As used in this disclosure, photoelectric is an adjective used to describe an electronic component in which the performance of the electronic component is modified by light. Typical photoelectric devices include, but are not limited to, photoelectric transistors, photoelectric diodes, and photoelectric resistors.

Photovoltaic Cell: As used in this disclosure, a photovoltaic cell is a photoelectric device that directly converts light energy into electrical energy.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Portable: As used in this disclosure, the term portable refers to an object with a form factor and weight that allows an individual to physically carry or manually transport the object to its intended destination.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Reservoir: As used in this disclosure, a reservoir refers to a container or containment system that is configured to store a liquid.

Rigid Structure: As used in this disclosure, a rigid structure is a solid structure formed from an inelastic material that resists changes in shape. A rigid structure will permanently deform as it fails under a force.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shell: As used in this disclosure, a shell is a structure that forms an outer covering intended to contain an object. Shells are often, but not necessarily, rigid or semi-rigid structures that are intended to protect the object contained within it.

Solid: As used in this disclosure, a solid refers to a state (phase) of matter that: 1) has a fixed volume; and, 2) does not flow.

Spray: As used in this disclosure, a spray is a plurality of liquid drops dispersed in a gas.

Spray Nozzle: As used in this disclosure, a spray nozzle is a device that receives liquid under pressure and disperses that liquid into the atmosphere as a spray.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

WiFi™: As used in this disclosure, WiFi™ refers to the physical implementation of a collection of wireless electronic communication standards commonly referred to as IEEE 802.11x.

Wireless: As used in this disclosure, wireless is an adjective that is used to describe a communication link between two devices that does not require the use of physical cabling.

Wireless Communication Establishment Technology: As used in this disclosure, a wireless communication establishment technology refers to technology that establishes a wireless communication link between a first logical device and a second logical device. Usually, the operation of a wireless communication establishment technology is initiated by the push of a button. An example of such a technology is the WiFi™ protected setup technology (WPS™).

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable clothes-washing machine comprising a housing structure, a fluid network, and a control circuit;

wherein the housing structure contains the fluid network and the control circuit;

wherein the control circuit controls the operation of the portable clothes-washing machine;

wherein the fluid network handles the flow of clean water and gray water through the portable clothes-washing machine;

wherein the housing structure is a rigid structure;

wherein the housing structure comprises a shell structure, a pedestal structure, and a basket structure;

wherein the shell structure is a prism shaped structure;

wherein the shell structure forms a containment structure of the housing structure;

wherein the shell structure is a rigid structure;

wherein the shell structure contains the fluid network, the control circuit, and the basket structure;

wherein the shell structure comprises a pan structure and a lid;

wherein the pan structure is a mechanical structure;

wherein the pan structure forms the containment structure of the shell structure;

wherein the pan structure is a prism shaped structure;

wherein the pan structure is formed as a pan;

wherein the lid is a disk shaped structure;

wherein the lid attaches to an open face of the pan structure such that the lid rotates relative to the pan structure;

wherein the lid rotates between a closed position and an open position;

wherein the lid controls access into the hollow interiors of the pan structure and the basket structure;

wherein a plurality of reservoirs comprises a clean water reservoir and a gray water reservoir;

wherein the clean water reservoir mounts on the exterior surface of the shell structure;

wherein the gray water reservoir mounts on the exterior surface of the shell structure;

wherein the pedestal structure is a load bearing structure;

wherein the pedestal structure attaches to an inferior surface of the shell structure;

wherein the pedestal structure elevates the shell structure above a supporting surface;

wherein the pedestal structure is a rolling structure;

wherein the basket structure transfers a load carried by the shell structure to the supporting surface;

wherein the basket structure is a prism shaped structure;

wherein the basket structure is formed as a pan;

wherein the basket structure forms a foraminous structure that allows water to flow into and out of a containment space formed by the basket structure;

wherein the basket structure inserts in the interior space of the shell structure;

wherein the basket structure inserts into the shell structure such that an open face of the basket structure is proximal to an open face of the shell structure;

wherein the basket structure contains the one or more garments during a cleaning process;

wherein the basket structure comprises an agitator and a suspension bar;

wherein the agitator is a mechanical structure;

wherein the agitator is a rotating structure;

wherein the agitator mounts in the basket structure of the housing structure;

wherein the control circuit provides the motive forces necessary to rotate the agitator;

wherein the control circuit controls the rotation of the agitator;

wherein the suspension bar is a structure that mounts within the agitator;

wherein the suspension bar is a load bearing structure;

wherein the suspension bar transfers the load of the one or more garments suspended from the suspension bar to the basket structure;

wherein the fluid network comprises a plurality of pumps;

wherein each of the plurality of pumps provides the motive forces necessary to move a liquid into and out of a reservoir selected from the plurality of reservoirs.

2. The portable clothes-washing machine according to claim 1 wherein the portable clothes-washing machine is an electromechanical device;

wherein the portable clothes-washing machine is configured for use with one or more garments;

wherein the portable clothes-washing machine cleans the one or more garments.

3. The portable clothes-washing machine according to claim 1 wherein the fluid network is a mechanical structure;

wherein the fluid network controls the flow of clean water and gray water through the housing structure;

wherein the fluid network controls the flow of clean water into the pan structure of the shell structure of the housing structure;

wherein the fluid network controls the flow of gray water out of the pan structure.

4. The portable clothes-washing machine according to claim 3 wherein each of the plurality of reservoirs is a fluid containment structure;

wherein each of the plurality of reservoirs contains a fluid selected from the group consisting of clean water and gray water;

wherein the control circuit provides the motive forces necessary to the transfer of liquids into and out of each of the plurality of reservoirs;

wherein the plurality of reservoirs controls the transfer of liquids into and out of each of the plurality of reservoirs.

5. The portable clothes-washing machine according to claim 4 wherein each of the plurality of pumps is a mechanical structure;

wherein each of the plurality of pumps generates a pressure differential used to transport a liquid into and out of a reservoir selected from the plurality of reservoirs;

wherein each of the plurality of pumps is electrically powered;

wherein the control circuit provides the electric energy necessary to power each pump selected from the plurality of pumps;

wherein the control circuit independently controls the operation of each pump selected from the plurality of pumps.

6. The portable clothes-washing machine according to claim 5 wherein the clean water reservoir is a reservoir;

wherein the clean water reservoir contains clean water used to clean the one or more garments;

wherein the gray water reservoir is a reservoir;

wherein the gray water reservoir contains the water used to clean the one or more garments;

wherein the gray water reservoir contains gray water that is generated after the one or more garments are cleaned by the portable clothes-washing machine.

7. The portable clothes-washing machine according to claim 6 wherein the plurality of pumps comprises a clean water pump and a gray water pump;

wherein the clean water pump is an electrically operated pump;

wherein the control circuit provides electric energy to necessary to operate the clean water pump;

wherein the control circuit controls the operation of the clean water pump;

wherein the clean water pump pumps clean water from the clean water reservoir into the containment space formed by the shell structure;

wherein the clean water pump discharges the clean water into the basket structure through a plurality of spray nozzles;

wherein the gray water pump is an electrically operated pump;

wherein the control circuit provides electric energy to necessary to operate the gray water pump;

wherein the control circuit controls the operation of the gray water pump;

wherein the gray water pump pumps gray water from the containment space formed by the shell structure into the gray water reservoir.

8. The portable clothes-washing machine according to claim 7 wherein the control circuit is an electric circuit;

wherein the control circuit controls the operation of the portable clothes-washing machine;

wherein the control circuit provides the motive forces that pump the clean water into the pan structure of the shell structure of the housing structure;

wherein the control circuit controls the operation of the clean water pump;

wherein the control circuit controls the operation of the gray water pump;

wherein the control circuit provides the motive forces necessary to rotate the agitator;

wherein the control circuit controls the operation of the agitator;

wherein the control circuit is an independently powered electric circuit;

wherein by independently powered is meant that the control circuit can operate without an electrical connection to an external power source.

9. The portable clothes-washing machine according to claim 8 wherein the control circuit comprises a logic module, a communication module, an agitator motor, and a power circuit;

wherein the logic module, the communication module, the agitator motor, and the power circuit are electrically interconnected;

wherein the communication module further comprises a wireless communication link and a personal data device;

wherein the wireless communication link forms a communication link between the personal data device and the communication module.

10. The portable clothes-washing machine according to claim 9 wherein the logic module is a programmable electric circuit;

wherein the logic module controls the operation of the clean water pump;

wherein the logic module controls the operation of the gray water pump;

wherein the logic module controls the operation of the agitator motor.

11. The portable clothes-washing machine according to claim 10 wherein the communication module is a wireless electronic communication device;

wherein the communication module establishes the wireless communication link between the control circuit and the personal data device;

wherein the personal data device is a programmable electrical device;

wherein the personal data device transmits operating instructions over the wireless communication link to the control circuit;

wherein the communication module receives the transmitted operating instructions and relays the received operating instructions to the logic module.

12. The portable clothes-washing machine according to claim 11 wherein the agitator motor is an electric motor;

wherein the agitator motor mechanically attaches to the agitator of the basket structure of the housing structure;

wherein the agitator motor electrically connects to the logic module;

wherein the logic module provides the electric energy necessary to power the operation of the agitator motor;

wherein the logic module controls the operation of the agitator;

wherein the agitator motor rotates the agitator such that the one or more garments contained in the basket structure are moved relative to each other.

13. The portable clothes-washing machine according to claim 12 wherein the power circuit is an electrical circuit;

wherein the power circuit powers the operation of the control circuit;

wherein the power circuit is an electrochemical device.

14. The portable clothes-washing machine according to claim 13 wherein the power circuit comprises a battery, a plurality of diodes, a charging port, an external power source, and a photovoltaic cell;

wherein the external power source further comprises a charging plug, a second positive terminal, and a second negative terminal;

wherein the battery, the plurality of diodes, the charging port, the external power source, the charging plug, and the photovoltaic cell are electrically interconnected;

wherein each of the plurality of diodes is a diode;

wherein each of the plurality of diodes controls the direction of the flow of electric current through the power circuit.

* * * * *